United States Patent [19]

Chang

[11] Patent Number: 5,031,417

[45] Date of Patent: Jul. 16, 1991

[54] EVAPORATOR OF ICE MACHINE

[75] Inventor: Eui-Young Chang, Seoul, Rep. of Korea

[73] Assignee: Samsung Electronics Co., Ltd., Kyungki-do, Rep. of Korea

[21] Appl. No.: 438,646

[22] Filed: Nov. 20, 1989

[30] Foreign Application Priority Data

Mar. 3, 1989 [KR] Rep. of Korea ..... 89-2451

[51] Int. Cl.[5] ..... F25C 1/12

[52] U.S. Cl. ..... 62/347; 62/515

[58] Field of Search ..... 62/347, 348, 352, 515, 62/524; 29/157.3 C

[56] References Cited

U.S. PATENT DOCUMENTS

| | | | |
|---|---|---|---|
| 2,232,176 | 2/1941 | Guthrie | 62/515 |
| 2,712,736 | 7/1955 | Wurtz et al. | 62/515 |
| 2,805,557 | 9/1957 | Hilger | 62/347 X |
| 3,074,252 | 1/1963 | Tippmann et al. | 62/347 |
| 3,423,952 | 1/1969 | Pugh | 62/347 X |
| 3,913,349 | 10/1975 | Johnson | 62/348 X |

*Primary Examiner*—William E. Tapolcai

*Attorney, Agent, or Firm*—Sterne, Kessler, Goldstein & Fox

[57] ABSTRACT

An evaporator of an ice machine operating on a typical ice-making cycle, comprising a heat-conducting metal plate member, an evaporator body formed by folding the metal plate member into a " "-shape after a refrigerant circuit including a capillary tube, refrigerant tube and evaporating tube etc., is oppositely mounted inside of the plate member, and means for fixing the evaporator body in a vertical position inside of the cabinet of an ice machine. The present invention improves productivity by resolving disadvantages such as the increase of the installation space and complex assembly. Moreover, easier and more accurate ice-separating may be attained according to the present invention.

5 Claims, 5 Drawing Sheets

EVAPORATOR OF ICE MACHINE

BACKGROUND OF THE INVENTION

This invention relates to an evaporator of ice machine, and particularly to an evaporator which remarkably simplifies the assembly and reduces the installing space of the ice machine body by giving a slope to its plate member.

Generally, an ice machine makes ice by spraying water thru a nozzle onto a cooled evaporator plate surface. The water is stored in a water tank. The evaporator plate is cooled by a refrigerant. The refrigerant leaves a compressor at high temperature and pressure. The refrigerant then enters a condenser where it is cooled. The refrigerant is then brought into heat transfer contact with the evaporator plate surface. The refrigerant is evaporated to thereby cool the plate surface. When the ice becomes thicker than a predetermined thickness, the high temperature and high pressure gas discharged from the compressor is sent to the evaporator through a two way valve. The high temperature and high pressure gas warms the plate surface and thus separates the ice. This is a typical ice-making cycle.

In constructing a conventional evaporator body 2 of ice machine 1 having the typical ice-making cycle, the evaporator body 2 and a lattice-type heater 14 is continuously formed with " "-shape as shown in FIG. 4. The installing space of the evaporator inside of a cabinet can be increased against the ice-making capacity.

As shown in FIG. 5, the evaporator 2 can be vertically positioned. In this configuration, water is sprayed to both sides of the plate member 3. A fixing part 19 is annexed at the upper side of plate member 3. An ice-guiding part 20 is also provided for guiding the ice to the storage position or to heater 14. The ice is not guided to a water tank which is installed in the lower side of plate member 3. This configuration makes the structure more complex and deteriorates productivity.

SUMMARY OF THE INVENTION

The present invention has been made in consideration of this and has for it object to provide an evaporator of an ice machine which can simplify the structure and the assembly process. The present invention achieves these objectives by providing an evaporator that comprises a folded heat-conducting plate member having a first and second side bent inwardly. This configuration reduces the installation space required and allows the ice to be easily separated from the plate member. The present invention also accurately guides the ice onto the heater.

The present invention operates with a typical ice-making cycle and comprises heat-conducting metal plate member; an evaporator body formed space by giving a constant slope inwardly to the plate member by folding the plate member into " "-shape after a refrigerant circuit including capillary tube, refrigerant tube and evaporating tube etc., is oppositely mounted inside of the plate member; means for fixing the evaporator body vertically inside of the cabinet of the ice machine. In addition, fixing grooves with a constant angle $\theta$ are formed at the fixing means respectively, so that the plate member of the evaporator body is slopingly set up toward the inside.

DETAILED DESCRIPTION OF THE INVENTION

The present invention will be now described in more detail with the accompanying drawings.

Figure 3A:
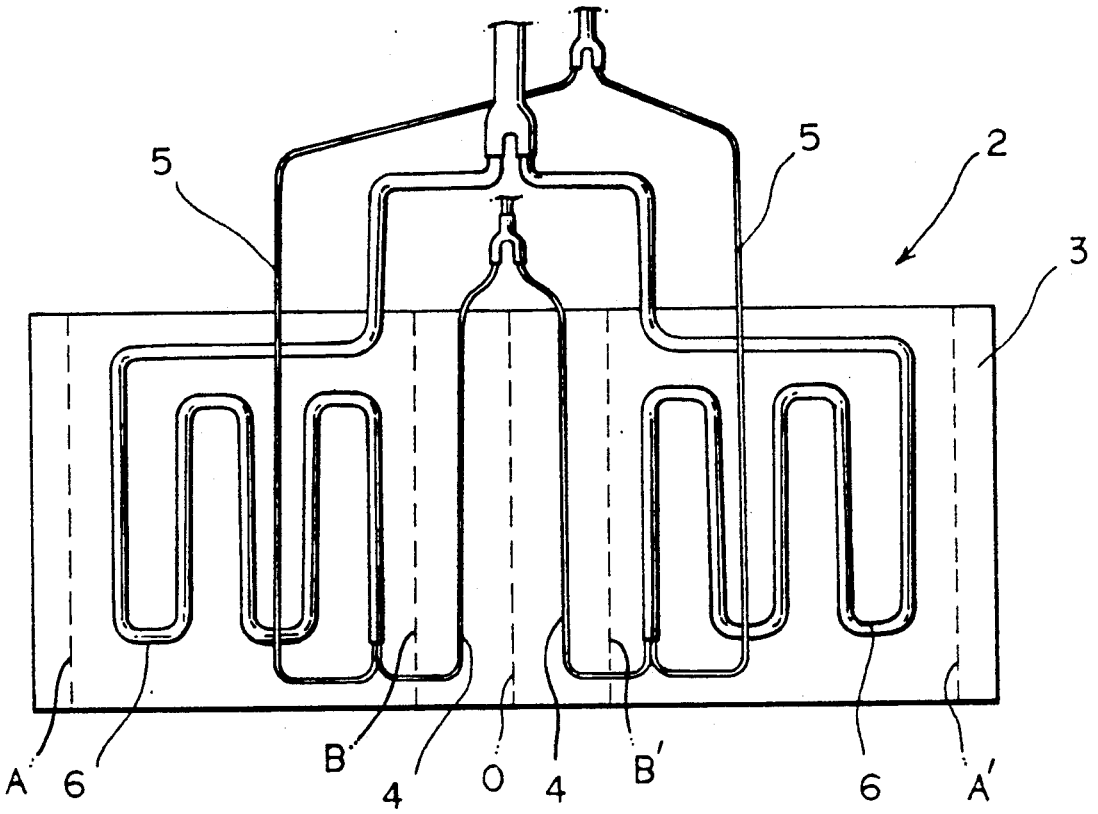
FIG. 3 is a development diagram of the evaporator body and a cross-sectional view after the bending.

FIGS. 3(*a*) and 3(*b*) show the pre-folded and folded views of evaporator body 2. The process of forming evaporator body 2 will now be described with reference to these drawings. First, a heat-conducting metal plate member 3 is formed as shown. Second, ends A and A' of plate member 3 are bent inwardly with a constant slope. Next, a capillary tube 4 is formed at regular intervals at both center sides of the plate member 3. Refrigerant tube 5 and evaporating tube 6 are set up to connect at both sides so that the refrigerant action is carried out through a general refrigerant circuit.

Figure 3B:
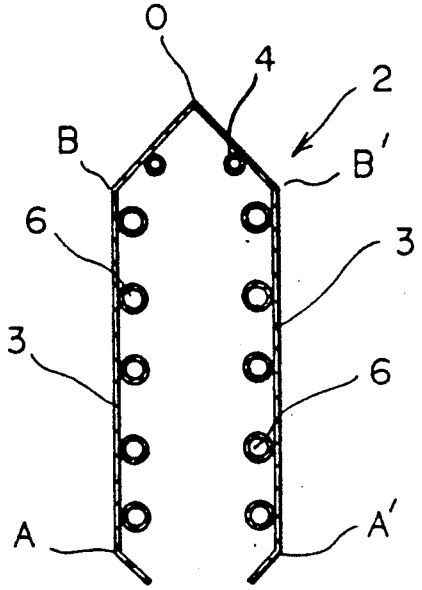
Figure 4:
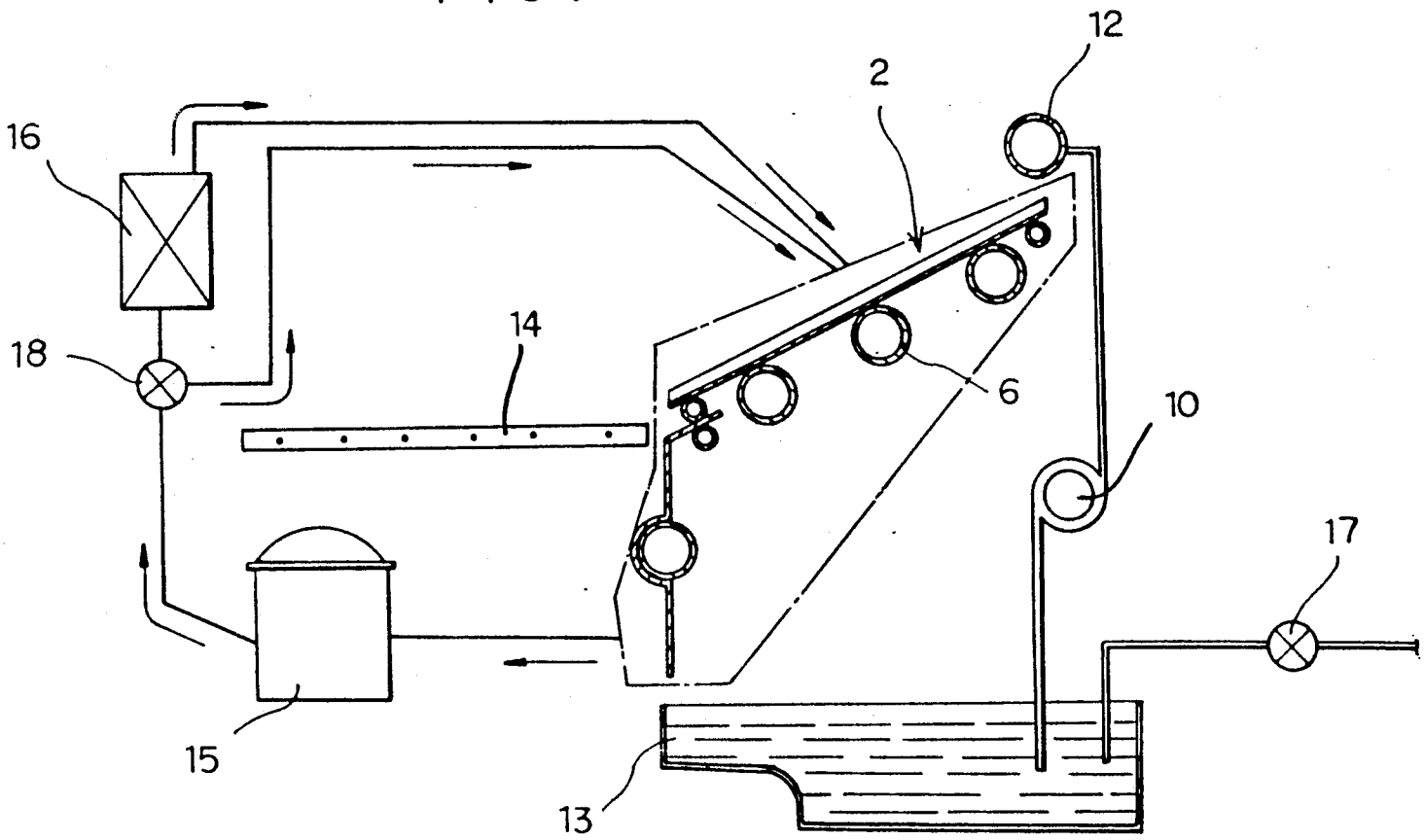
FIG. 4 and FIG. 5 are views showing the conventional evaporator structure.
Figure 5:
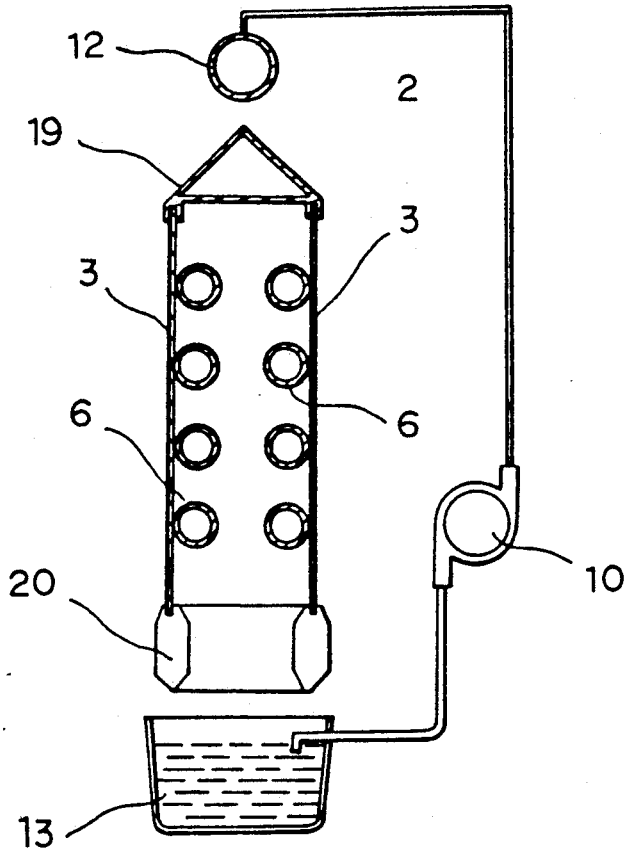

By folding the center O and parts B and B' of the plate member 3 as shown in FIG. 3(B), the evaporator body 2 is formed with " "-shape.

Figure 1:
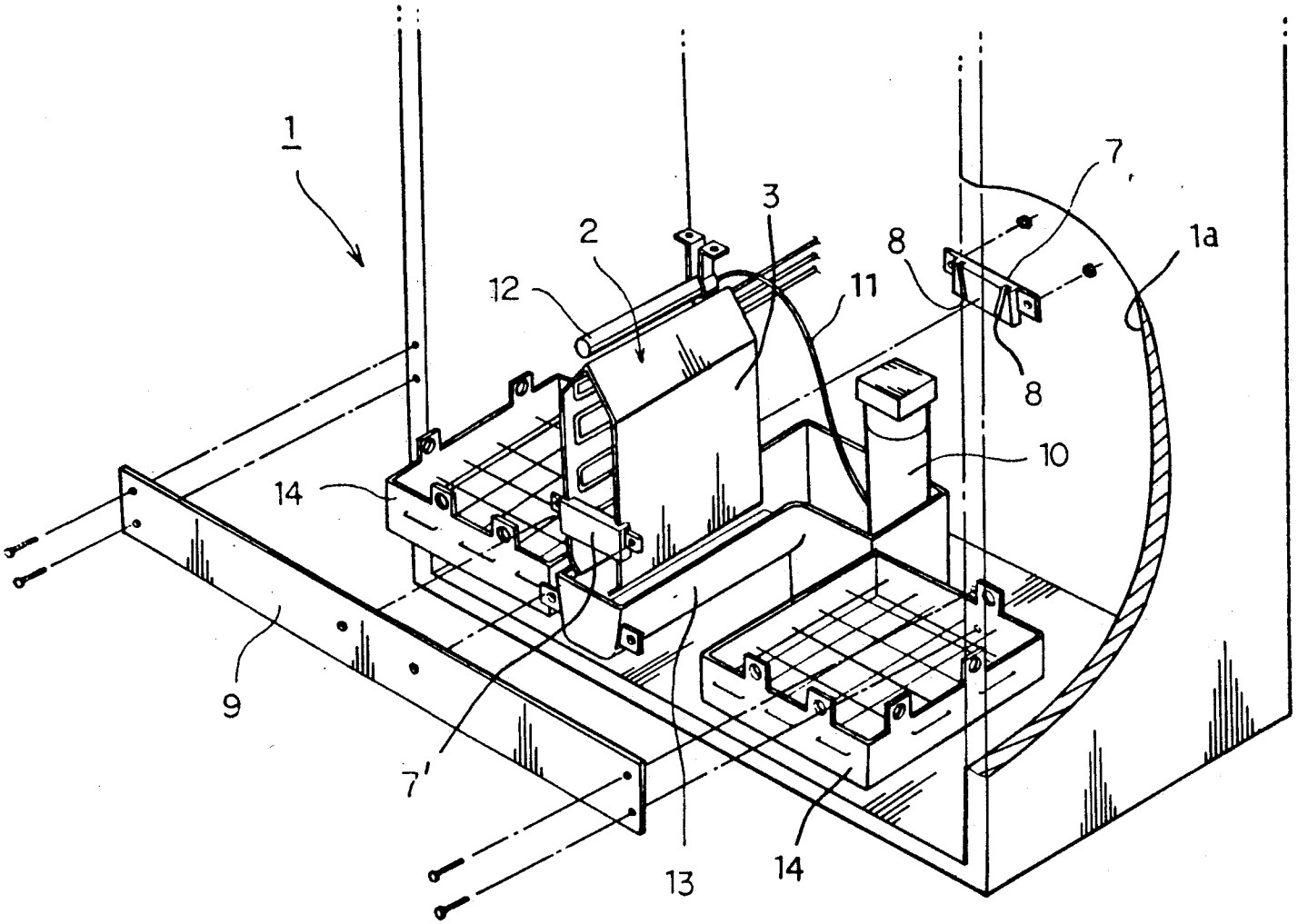
FIG. 1 is a separated perspective view of the major part of the ice machine according to the present invention.

The evaporator body 2 formed as mentioned above is fixed using fixing means 7 and 7' installed fixedly at a cabinet 1*a* of the ice machine 1 as shown in FIG. 1. Fixing means 7 and 7' have fixing grooves 8 which are sloped at a constant angle $\theta$. The one side of plate member 3 of the evaporator body 2 is set up at the fixing groove 8 of the fixing means 7 with a constant slope of the angle $\theta$, the opposite side of the plate member 3 is assembled firmly by another fixing means 7'. This fixing means 7' is assembled at a middle diaphragm plate 9 fixed at the ice machine body 1 so that the evaporator body 2 is fixedly installed within the internal space of ice machine 1.

Figure 2:
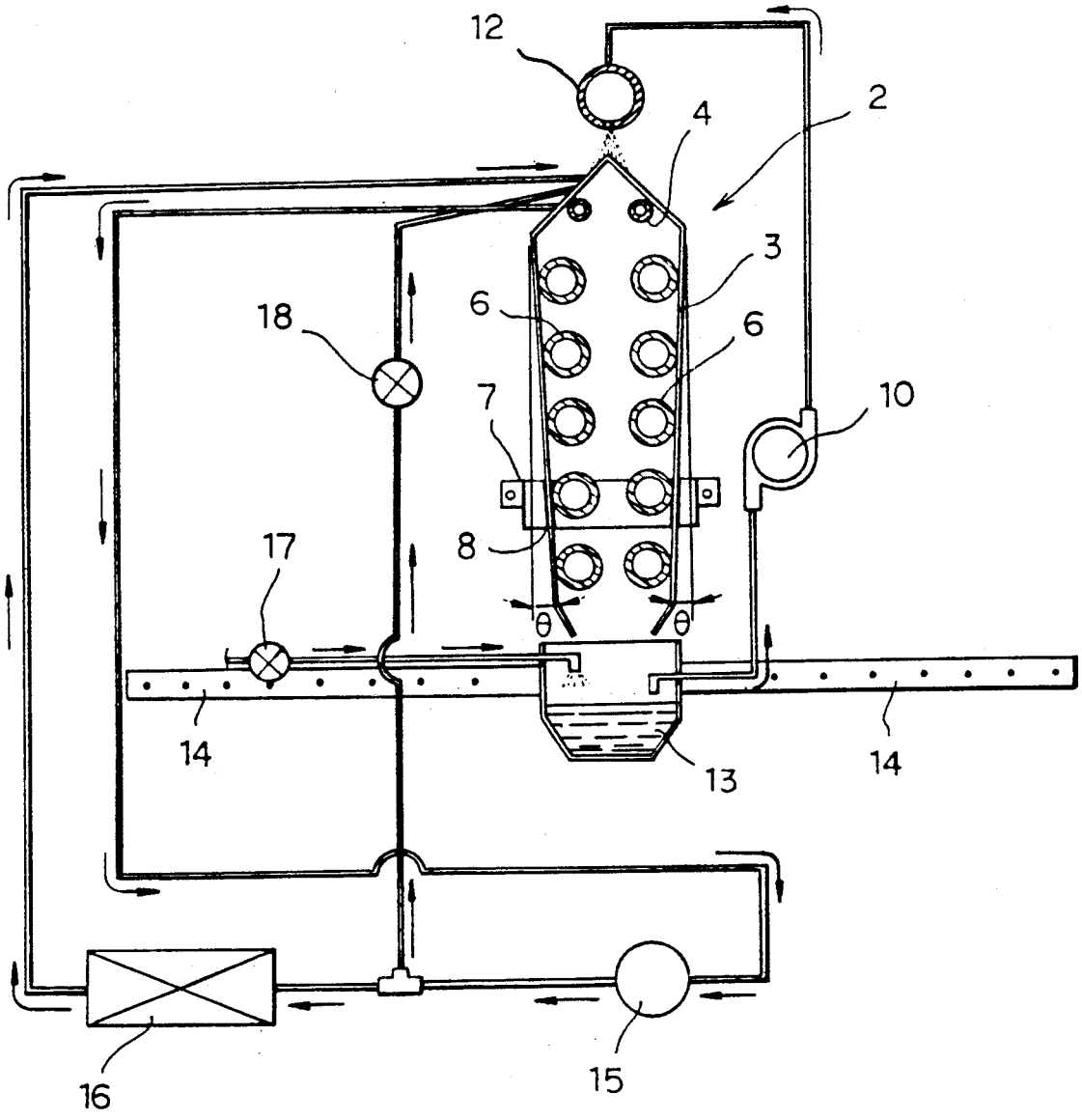
FIG. 2 is a system diagram to explain the operation of the ice machine according to the present invention.

A spraying nozzle 12 connected to a water supply pump 10 and a hose 11 is placed at the upper side of the center of the evaporator body 2. Referring to FIG. 2, a water tank 13 is shown positioned below the evaporator body 2. Lattice-type heater 14 is established at both the left and right lower sides of the evaporator body 2. Each refrigerant circuit is connected to a compressor 15 and a condenser 16. Also, the number 17 designates a valve for supplying the water tank 13 with water and the number 18 designates a two-way valve.

The operation of the present invention with the above structure will now be explained.

As mentioned above the evaporator 2 mounted within the ice machine 1 with the typical ice-making cycle has the capillary tube 4, the refrigerant tube 5 and evaporating tube 6 located oppositely at the inner side of the heat-conducting metal plate member 3. The evaporator 2 is vertically set up inside of the cabinet 1*a* of the ice machine by using the fixing means 7 and 7' as shown in FIG. 1 and FIG. 2 after the evaporator plate member 3 is formed into the " "-shape. In operation the high temperature and high pressure refrigerant gas discharged from the compressor 15 is condensed at the condenser 16 and flows into the evaporator body 2 after pressure drop through the capillary tube 4. The resulting low temperature and low pressure refrigerant is evaporated in evaporating tube 6 attached to plate member 3 of the evaporator body 2. As the evaporation of the refrigerant takes place, plate member 3 is cooled by heat transfer from evaporating tube 6. Thereafter, the refrigerant returns to compressor 15 through the outlet of the evaporating tube 6.

Water is supplied into the water tank 13 above the predetermined level by opening the valve 17 connected to bib cock, the water is supplied to the spraying nozzle 12 placed at the upper part of the evaporator body 2 with the constant pressure according to the operation of the water supply pump 10. Subsequently, the water is sprayed to both left and right surfaces of the plate member 3 so that the flowing water around the cooled evaporating tube 6 is continuously frozen. Accordingly, the size of the ice becomes increasingly larger. At this time, when the thickness of the ice becomes the predetermined thickness, the operation of the water supply pump 10 is stopped and the two way valve 18 is controlled prevents the high pressure and high temperature refrigerant gas exiting the compressor 15 from flowing into the condenser 16 so that the refrigerant gas directly flows into the refrigerant tube 5 attached to the metal plate member 3.

Thus, the contact interface of the frozen ice on the surface of the plate member 3 melts since the refrigerant gas with high temperature and high pressure heats the plate member 3. The ice is then is separated to be induced on the lattice type heater 14 attached at both sides of the evaporator 2.

As can be seen, both sides of the plate member 3 of the evaporator body 2 is attached to the fixing grooves 8 formed at the fixing means 7 and 7' with a constant angle $\theta$ so that both sides of plate member 3 have a constant slope inwardly with respect to the vertical. Therefore, ice-separation becomes more easily achieved and the hexahedral ice shapes are accurately guided onto the heater 14.

When the ice-separation is completed, the two-way valve 18 is controlled to the original position which causes the refrigerant gas with high temperature and high pressure discharged from the compressor 15 into the condenser 16 so that the cooling cycle resumes. Thereafter, the water supply pump 10 is opened to supply the spraying nozzle 12 with the water, and the water is sprayed on the surface of the plate member 3 of the evaporator body 2, thereby making the ice again. By doing this repeatedly, the ice-making cycle for freezing and separating the ice can be carried out.

As mentioned above, the present invention can improve the productivity since various disadvantages such as the increase of the installing space, the complex assembly, etc., are solved by setting up the superior heat-conducting " "-shape plate member 3 of the evaporator body 2 inside of the ice machine 1 using the fixing means 7 and 7' to be inclined by the constant angle $\theta$. In addition, the present invention can separate accurately the ice and make the ice-separation more easily.

The invention is in no way limited to the embodiment described hereinabove. Various modifications of disclosed embodiment as well as other embodiments of the invention will become apparent to persons skilled in the art upon reference to the description of the invention. It is therefore contemplated that the appended claims will cover any such modifications or embodiments as fall within the true scope of the invention.

What is claimed is:

1. An evaporator system for use in an ice machine, comprising:

a thermally conductive plate member folded to form first and second sides, said first and second sides having respective first and second ends, said first and second sides being inwardly bent from the vertical position;

a refrigerant circuit formed opposite said first and second sides, said refrigerant circuit being in heat transfer contact with said plate member; and means for securing said thermally conductive plate member within said ice machine, said means for securing comprising fixing grooves for receiving said first and second sides.

2. An evaporator system of claim 1, wherein said thermally conductive plate member is metal.

3. An evaporator system of claim 1, further comprising a spraying nozzle opposite said first and second ends for supplying water to said first and second sides.

4. An evaporator system of claim 3, further comprising a water tank situated below said first and second ends.

5. An evaporator system of claim 4, further comprising a pump and hose means for transporting water from said tank to said spraying nozzle.

* * * * *